US005950302A

United States Patent [19]

Delves et al.

[11] Patent Number: 5,950,302

[45] Date of Patent: Sep. 14, 1999

[54] METHOD OF MAKING A STATOR APPARATUS HAVING IMPROVED GROUNDING ARRANGEMENT

[75] Inventors: Rodney G. Delves, Fajardo, Puerto Rico; Steven L. Johnson, Aiken, S.C.

[73] Assignee: Power Parts, Inc., Santa Isabel, Puerto Rico

[21] Appl. No.: 08/948,699

[22] Filed: Oct. 10, 1997

Related U.S. Application Data

[62] Division of application No. 08/472,335, Jun. 7, 1995, Pat. No. 5,721,524.

[51] Int. Cl.[6] ..... H01F 41/00

[52] U.S. Cl. ..... 29/606; 29/605

[58] Field of Search ..... 29/605, 606, 602.1; 336/92, 96, 107, 234

[56] References Cited

U.S. PATENT DOCUMENTS

| | | |
|---|---|---|
| 3,858,956 | 1/1975 | Garrett . |
| 3,910,663 | 10/1975 | Winger . |
| 3,979,707 | 9/1976 | Prince, Jr. . |
| 4,036,201 | 7/1977 | Burson . |
| 4,423,542 | 1/1984 | Stolarczyk . |
| 4,557,537 | 12/1985 | Greer . |
| 4,568,903 | 2/1986 | Buckley . |
| 4,587,942 | 5/1986 | Burson . |
| 4,636,015 | 1/1987 | Ford, Jr. . |
| 4,746,890 | 5/1988 | Buckley et al. . |
| 4,862,491 | 8/1989 | La Salle et al. . |
| 4,924,831 | 5/1990 | Piteo et al. . |
| 4,962,361 | 10/1990 | Ida . |
| 5,218,760 | 6/1993 | Colton et al. . |
| 5,313,927 | 5/1994 | Takaishi . |
| 5,437,259 | 8/1995 | Hamada et al. . |

*Primary Examiner*—Carl E. Hall
*Attorney, Agent, or Firm*—Dority & Manning, P.A.

[57] ABSTRACT

A improved stator apparatus for use in the ignition system of an internal combustion engine. The stator apparatus comprises a magnetically permeable core having a coil housing mounted to a leg portion thereof. A coil assembly including a voltage transformer is maintained in the coil housing. The various coils of the coil assembly are mounted about a central chimney member of the housing coaxial with the portion of the core extending therethrough. A circuit grounding member is electrically connected between the voltage transformer and the core by frictional contact therebetween. The circuit grounding member is constructed of a generally flat conductive piece having a longitudinal ridge defined along a portion of its length. In exemplary constructions, the longitudinal ridge extends along side a portion of the core and is biased into frictional contact therewith. The ridge facilitates assembly of the stator apparatus as well as enhancing electrical connection of the grounding member with the core.

2 Claims, 8 Drawing Sheets

METHOD OF MAKING A STATOR APPARATUS HAVING IMPROVED GROUNDING ARRANGEMENT

This is a division of application Ser. No. 08/472,335 filed Jun. 7, 1995, now U.S. Pat. No. 5,721,524

BACKGROUND OF THE INVENTION

The present invention relates to ignition systems for use with spark-ignited internal combustion engines. More particularly, the present invention relates to improvements in the construction of a stator apparatus for use with such an ignition system.

Ignition systems for small gasoline engines include a transformer having a primary coil and a secondary coil related by a predetermined step-up ratio. The transformer coils are wound about a magnetically permeable core which is fixedly mounted with respect to the engine. A magnet assembly is provided, typically on the engine flywheel, to revolve about an axis in synchronism with operation of the engine. During operation, pole faces of the magnet are periodically moved past opposing pole faces of the core as a result of the magnet's revolution. In this manner, a time-varying magnetic flux is generated in the core.

These ignition systems have generally been divided into two broad classes, i.e., inductive type and capacitive discharge ("CD") type. Ignitions of each class include various circuit components connected to the primary coil of the transformer. Such circuit components utilize the time-varying flux produced in the core to cause a change in current flowing through the primary coil. As a result, a desired higher voltage will be induced on the secondary coil, which is connected to the engine's spark plug.

The transformer coils and various other circuits components are typically maintained within a coil housing mounted on one or more legs of the core. The overall stator apparatus comprising the core, along with the housing and circuitry contained therein, is typically attached to the cylinder head of the engine. Specifically, bolts extending through the core engage threaded bosses on the engine head to maintain the stator apparatus in position.

The electrical circuitry of the stator apparatus is electrically connected to the cylinder head to maintain a relative ground for the various voltage levels produced therein. Generally, this ground is established by a grounding member extending from the top of the stator housing and maintained in contact with the core. Various configurations have been provided for this grounding member. For example, electrical connection between the core and the grounding member has often been established by spot welding the grounding member to the core. While effective in providing the desired electrical connection, this technique has added a welding step to the process of assembling the stator unit. Other configurations have also been provided in which contact between the grounding member and the core is maintained frictionally. As will be explained in more detail below, these prior art frictional grounds may not be optimal in many applications.

SUMMARY OF THE INVENTION

The present invention recognizes and addresses the foregoing disadvantages, and others, of prior art constructions and methods. Accordingly, it is an object of the present invention to provide an improved stator apparatus for use in an ignition system of an internal combustion engine.

It is a further object of the present invention to provide such a stator apparatus incorporating an improved circuit grounding arrangement.

It is a more particular object of the present invention to provide such a stator apparatus incorporating a circuit grounding arrangement which facilitates assembly of the stator apparatus in a mass production situation.

It is a more particular object of the present invention to provide such a stator apparatus which incorporates a circuit grounding arrangement which facilitates testing of the stator apparatus in a mass production situation.

It is a more particular object of the present invention to provide such a stator apparatus incorporating a circuit grounding arrangement which facilitates enhanced frictional contact with the core.

It is also an object of the invention to provide an improved circuit grounding member for use with such a stator apparatus.

It is also an object of the present invention to provide an improved method of assembling such a stator apparatus.

Some of these objects are achieved by a stator apparatus utilized in an ignition system of an internal combustion engine. The stator apparatus comprises a magnetically permeable core having at least two leg portions interconnected by a crossbar portion. The leg portions are laterally spaced and extend substantially in parallel to each other. A coil housing is provided including at least one elongated central chimney member defining a receiving bore through which a portion of the core extends. A coil assembly including a voltage transformer having a primary coil and a secondary coil is maintained in the coil housing. The various coils of the coil assembly are mounted about the central chimney member coaxial with the portion of the core extending therethrough. A circuit grounding member is electrically connected to the core by frictional contact therewith. The circuit grounding member is constructed of a generally flat conductive piece having a longitudinal ridge defined along a portion of its length. Preferably, the longitudinal ridge extends alongside a portion of the core and is biased into frictional contact therewith.

In presently preferred embodiments, the circuit grounding member may be constructed of a unitary substantially flat piece of metal configured to define a longitudinal first section. A pair of terminal tabs may be further defined in the piece of metal and located at an end of the first section, with respective of the terminal tabs being located on opposite sides of the first section. A pair of ledge tabs may also be defined in the piece of metal and respectively located adjacent one of the terminal tabs. Further, a longitudinal second section may be defined in the piece of metal axially aligned with the first section and having a width less than the width thereof. A longitudinal stiffening ridge is further defined along at least a portion of the length of the second section. A pair of spring tab portions may further be defined in the second section by a bend across each corner at a terminus end thereof.

Other objects of the invention are achieved by a method of assembling a stator apparatus for use in an ignition system of an internal combustion engine. The method comprises the step of providing an ignition coil unit including a circuit grounding member having an unencapsulated portion extending vertically upwardly from a housing body thereof in a direction substantially parallel to a central receiving bore defined in the housing body. The unencapsulated portion of the circuit grounding member defines a longitudinal ridge therein to provide stiffening. As a further step, a testing probe is moved into contact with the circuit grounding member to test electrical characteristics of the ignition coil unit. A further step involves folding the unencapsulated portion of the circuit grounding member such that a folded portion thereof extends transversely to an opening of the receiving bore. Additionally, a longitudinal portion of a magnetically permeable core is placed onto the folded portion of the circuit grounding member and through the receiving bore. As a result, electrical connection is attained between the circuit grounding member and the core through frictional contact therebetween.

To reduce crimp fatigue in the circuit grounding member when folded, an enhanced radius portion may be defined therein at its bend location. Preferably, such an enhanced radius portion may be characterized by a radius of at least one and one-half (1.5) millimeters.

Other objects, features, and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
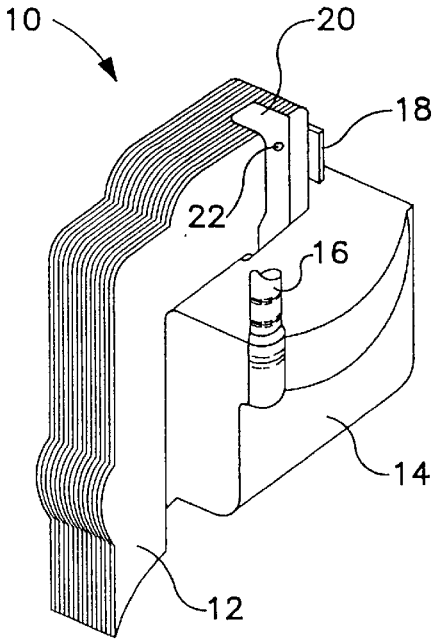
FIG. 1 PRIOR ART
FIG. 1 is perspective view of a first prior art stator apparatus.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention, which broader aspects are embodied in the exemplary constructions.

FIG. 1 illustrates a stator 10 of a type which has typically been constructed according to the prior art. As shown, stator 10 includes a magnetically permeable core 12 having a housing 14 mounted thereon. Housing 14 contains various circuit components utilized to generate the high voltage necessary to produce an ignition spark. This high voltage is applied to the engine's spark plug via a spark plug wire 16. A terminal 18 extends from the top of housing 14 adjacent core 12, as shown. Terminal 18 allows a stop switch to be electrically connected to the circuitry within housing 14 so that the ignition system may be disabled.

A circuit grounding member 20 also extends from the top of housing 14 and is partially folded over core 12 as shown. Member 20 is spot welded to core 12, as shown at 22, to maintain electrical connection therebetween. For reasons which will become apparent below, member 20 is generally constructed to be relatively thick so that they extend rigidly upright during the manufacture of stator 10. For example, commercial embodiments have been constructed wherein the thickness of member 20 is approximately 0.635 millimeters.

Figure 2:
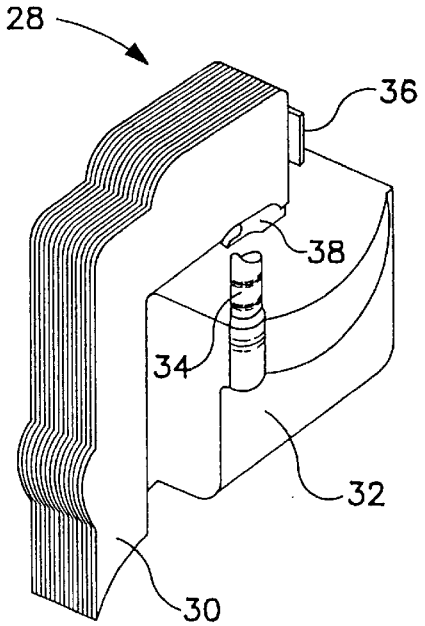
FIG. 2 is a view similar to FIG. 1 illustrating a stator apparatus constructed in accordance with the present invention.

FIG. 2 illustrates a stator unit (generally indicated at 28) constructed in accordance with the present invention. As can be seen, stator 28 is similar in many respects to stator 10. For example, stator 28 includes a magnetically permeable core 30 having a housing 32 mounted thereon. A spark plug wire 34 extends from housing 32 to permit electrical connection to the engine's spark plug. A terminal 36 is also provided to allow connection of the circuit components within housing 32 to a stop switch.

As can be seen, stator 28 does not have a grounding member such as grounding member 20 of stator 10. Instead, stator 28 includes a grounding member 38 which maintains contact with core 30 through frictional engagement. As a result of this construction, the spot welding step which had been required in the manufacture of stator 10 may be eliminated. It will be appreciated that the elimination of such a step in a mass production situation may often lead to significant cumulative cost savings.

Figure 3:
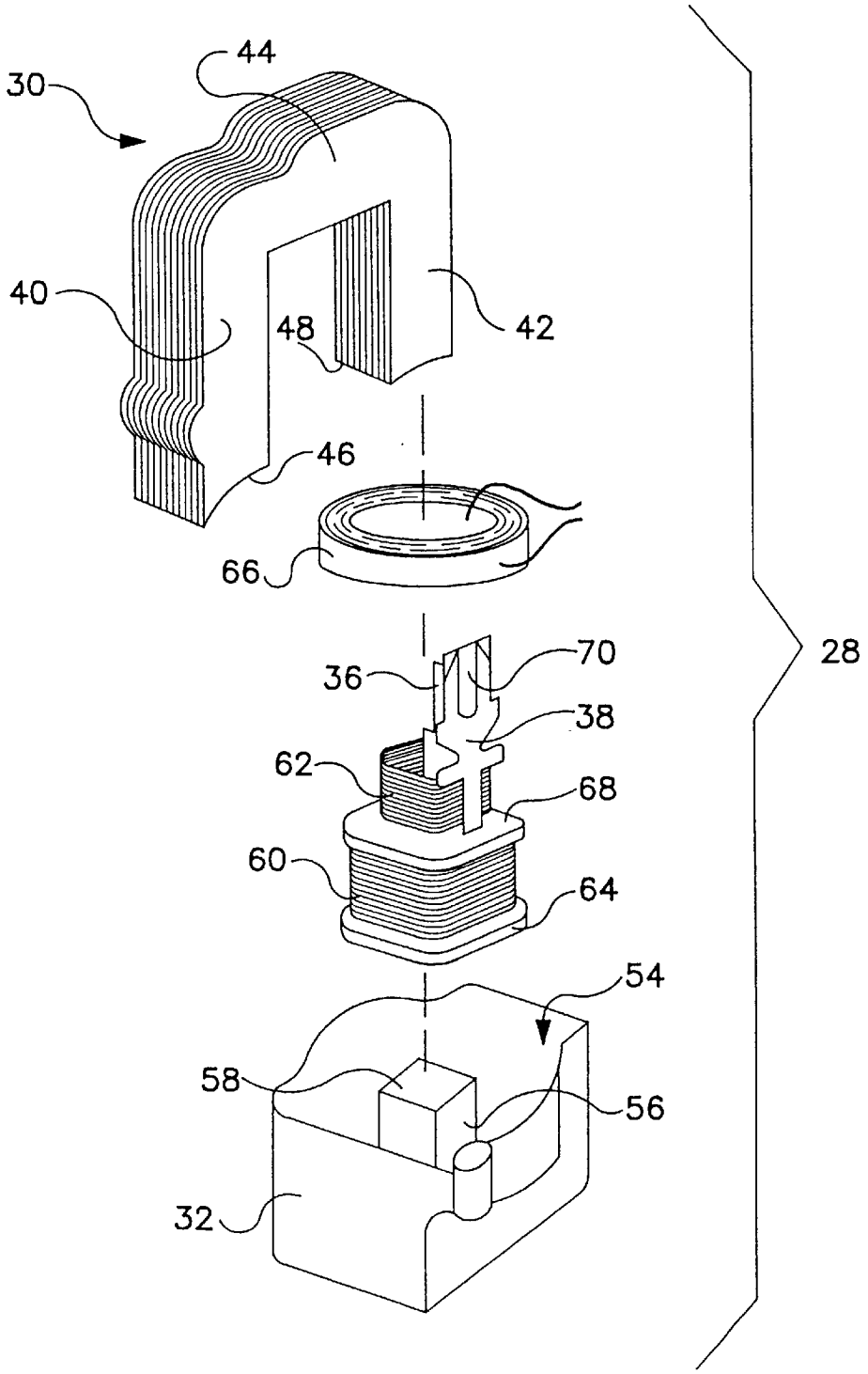
FIG. 3 is an exploded view of a stator apparatus such as that illustrated in FIG. 2.

Various components of stator 28 are shown separated in FIG. 3 for purposes of explanation. As can be seen, core 30 includes in this case two leg portions 40 and 42 interconnected by a transverse crossbar portion 44. Each of leg portions 40 and 42 includes an arcuate end surface, as respectively indicated at 46 and 48, proximate to which the orbiting permanent magnet will pass. Although the illustrated core has two leg portions, it should be appreciated that embodiments may be constructed that have different numbers of leg portions, such as three leg portions.

Housing 32 is preferably constructed as a unitary cup member defining a cavity 54 in the interior thereof. A chimney member 56 extends up through the central region of cavity 54 to define a receiving bore 58. Leg portion 42 of core 30 will extend completely through receiving bore 58 when stator 28 is assembled. The various coils within housing 32 are situated in cavity 54 about chimney member 56 so that they will be coaxial with leg portion 42.

For purposes of explanation, it may be assumed that stator 28 is constructed as a CD ignition, although it should be understood that inductive ignitions may also be constructed according to the present invention. The various circuitry of a suitable CD ignition are described in U.S. Pat. No. Re. 31,837, incorporated fully herein by reference. In this case, stator 28 will include a charge coil 60 for energizing a storage capacitor. At a predetermined time after a sufficient charge has accumulated on the capacitor, an electronic switch such as an SCR is "opened" to allow this charge to flow through primary coil 62.

As shown, charge coil 60 and primary coil 62 may be mounted on a carrier 64 which also maintains the storage capacitor and other components of the electronic circuitry. The secondary coil of the transformer is wound in this exemplary case as a conductive film on a bobbin 66 of thin paper. To minimize losses within core 30, bobbin 66 is preferably mounted directly coaxial to coil 62. Thus, carrier 64 includes a ledge 68 upon which bobbin 66 may sit so that it will be coaxial to coil 62 as desired. After the coils are situated in housing 32, cavity 54 is filled with a polymeric potting compound. As a result, the various coils and other circuit components will be encapsulated in housing 32.

As can be seen, terminal 36 and grounding member 38 are mounted to carrier 64 prior to bobbin 66 being inserted thereon. As a result, it is desirable for terminal 36 and grounding member 38 to extend vertically during assembly into the area within the inner diameter of bobbin 66. After assembly of stator 28 is completed, stop switch terminal 36 will continue to extend vertically as shown in FIG. 2. In this regard, terminal 36 is preferably constructed to be relatively thick and rigid such that it will not be subject to flexing or bending during assembly. Similarly, grounding member 20 of prior art stator 10 could be made relatively thick and rigid to avoid bending or flexing during assembly, as noted above.

As will be explained more fully below, grounding member 38, on the other hand, will be bent during assembly to extend into receiving bore 58 alongside leg portion 42. To facilitate this bending, it is generally desirable that grounding member 38 be constructed to be relatively thin. For example, grounding member 38 may have a thickness not exceeding 0.012 inches. In exemplary constructions, member 38 may have a thickness of approximately 0.006 inches.

A grounding member which is thinly constructed in this manner would often have the disadvantage of being subject to flexing. If such flexing occurred during assembly in an outward direction, grounding member 38 could bind with bobbin 66. In accordance with the present invention, this undesirable flexing is reduced by the configuration of member 38. Specifically, grounding member 38 includes a longitudinal ridge 70 defined along a portion of its length. Ridge 70 stiffens grounding member 38 such that it tends to remain upright more readily than a similar piece constructed without such a ridge. As a result, the likelihood of grounding member 38 binding with bobbin 66 is reduced.

Figure 4:
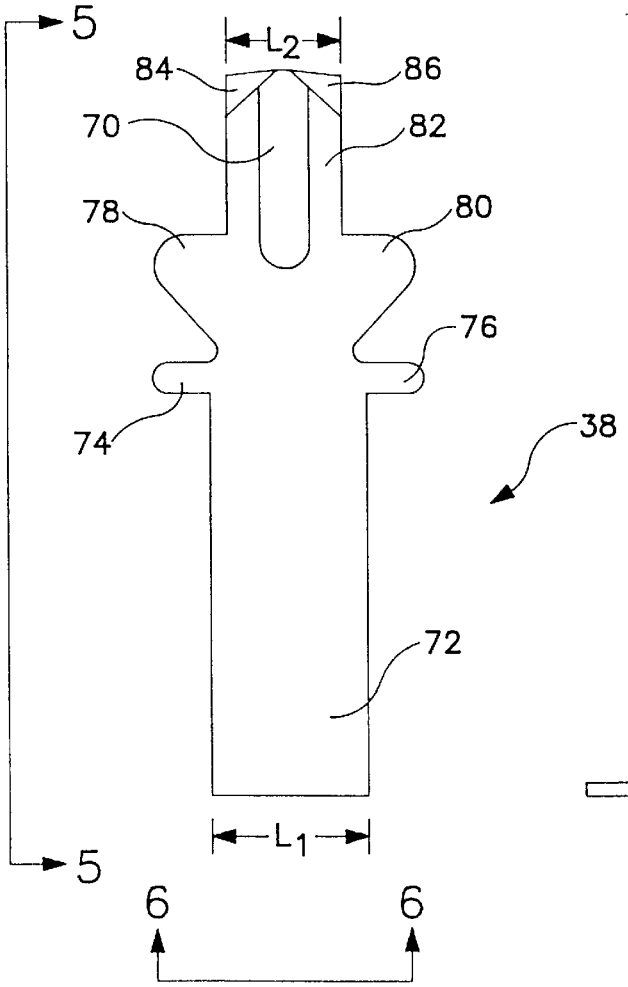
FIG. 4 is a front elevational view of an exemplary circuit grounding member constructed in accordance with the present invention.

The details of an exemplary configuration of grounding member 38 may be most easily explained with reference to FIGS. 4 through 6. As can be seen, member 38 includes a generally rectangular longitudinal portion 72, having a width $L_1$. A pair of terminal tabs 74 and 76 are located at an end of portion 72. During use, terminal tabs 74 and 76 provide a location to which ground leads of primary coil 62 and the secondary coil of bobbin 66 may be connected.

A pair of ledge tabs 78 and 80 are located adjacent respective of terminal tabs 74 and 76. A second longitudinal portion 82 extends axially outward from ledge portions 78 and 80 as shown. As can be seen, portion 82 has a width $L_2$ which is less than the width $L_1$ of portion 72. Ledge portions 78 and 80 are provided to ensure that no more than portion 82 will be inserted into receiving bore 58 during assembly of stator 28. Member 38 also includes a pair of spring tabs 84 and 86 formed by a bend across each corner of portion 82 at its terminus end.

Figure 5:
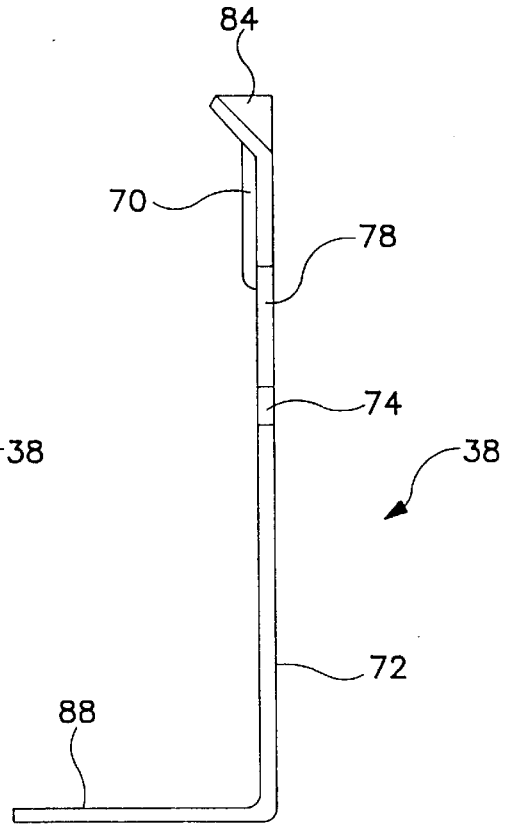
FIG. 5 is a side elevational view thereof as taken along lines 5—5 of FIG. 4.
Figure 6:
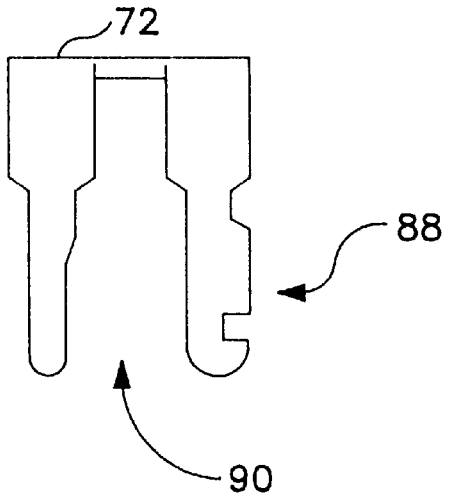
FIG. 6 is a bottom elevational view thereof as taken along lines 6—6 of FIG. 4.

As can be seen most clearly in FIGS. 5 and 6, grounding member 38 further includes a portion 88 situated substantially orthogonal to portion 72. During use, portion 88 would typically extend into a region between charge coil 60 and primary coil 62. The specific configuration of portion 88 will depend upon the particular circuit arrangement of stator 28. It can be seen in the illustrated configuration, however, that portion 88 includes a relatively convoluted outer surface and defines an interior opening 90, the combination of which functions to facilitate the various electrical connections.

Figure 7:
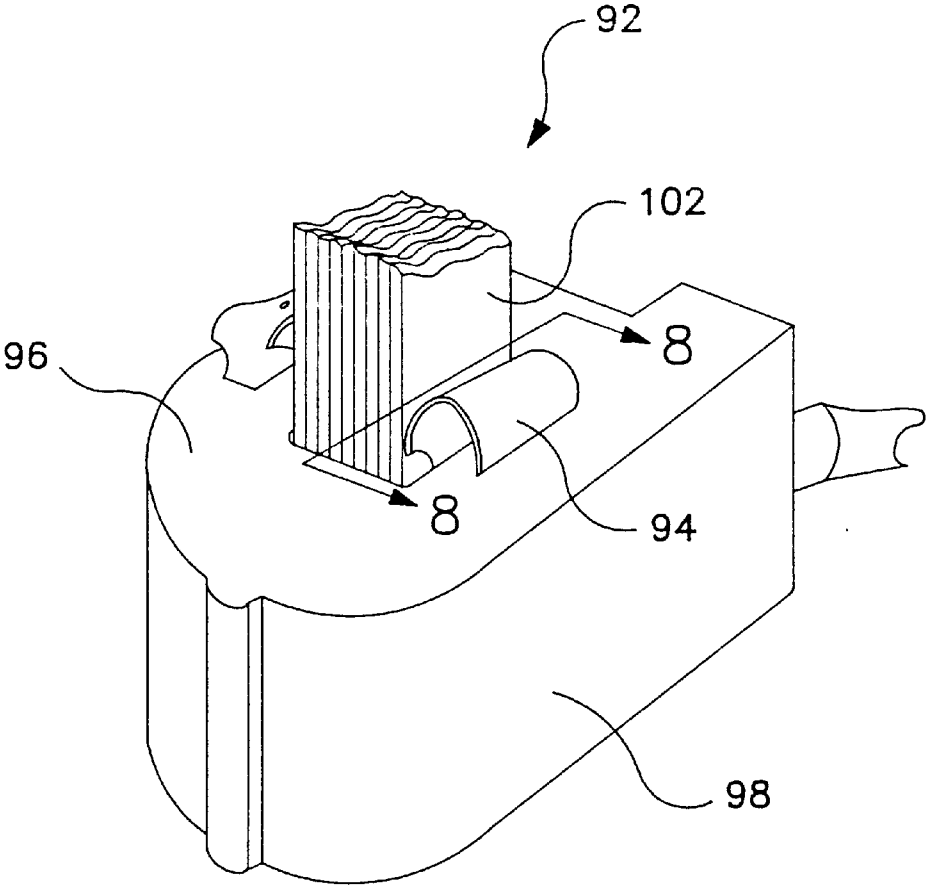
FIG. 7 PRIOR ART
FIG. 7 is a perspective view of a second prior art stator apparatus.

As noted above, ignition stators have been provided in the past in which electrical contact between the grounding member and the core is frictionally maintained. For example, one known stator is generally indicated at 92 in FIG. 7. As shown, grounding member 94 of stator 92 extends from a top surface 96 of housing 98. From top surface 96, grounding member 94 turns and extends into a receiving bore 100 (FIG. 8) defined in the central area of housing 98. A leg portion 102 of a magnetically permeable core is also inserted into bore 100. Frictional contact between member 94 and leg portion 102 provides the electrical connection to facilitate grounding. Grounding member 94 is believed to have a thickness of approximately 0.025 inches.

Figure 8:
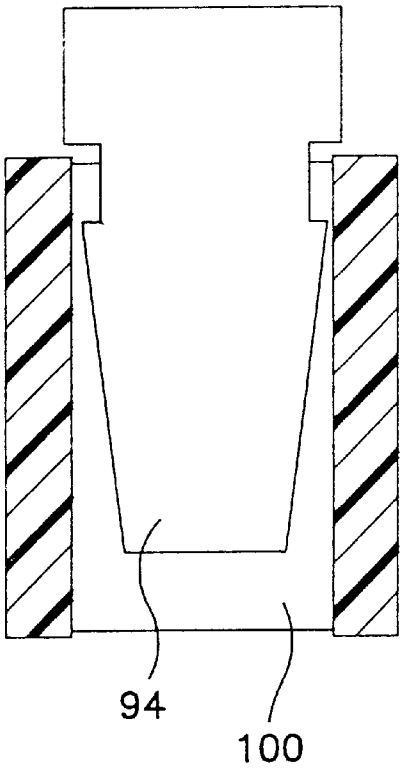
FIG. 8 PRIOR ART
FIG. 8 is a partial cross-sectional view as taken along lines 8—8 of FIG. 7.

As can be seen most clearly in FIG. 8, grounding member 94 extends well into bore 100. In fact, grounding member 94 extends into bore 100 a distance which is only slightly less than the extent of bore 100 itself. The portion of grounding member 94 extending into bore 100 is thus significantly greater than the width of bore 100.

Figure 9:
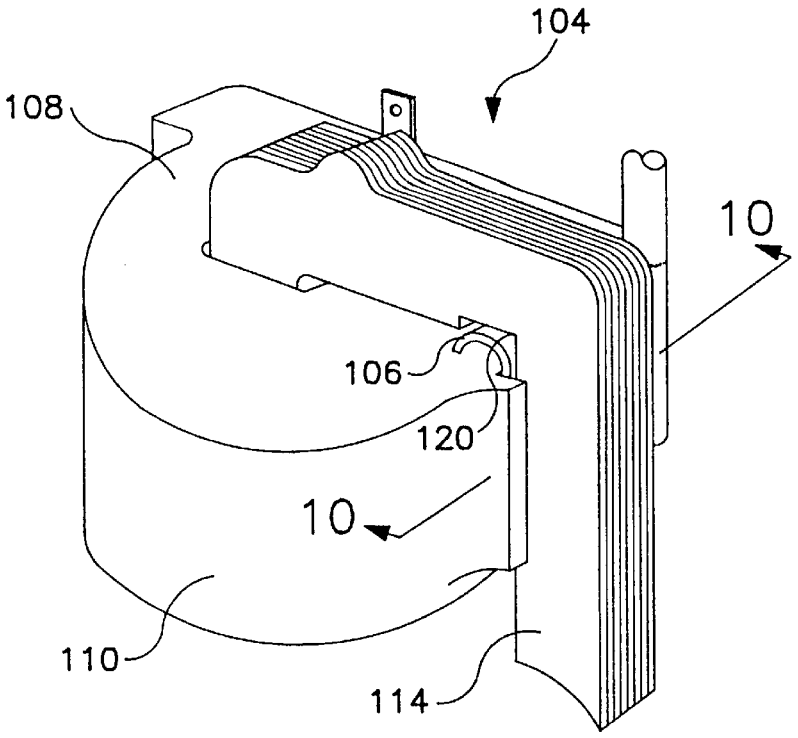
FIG. 9 PRIOR ART
FIG. 9 is a perspective view of a third prior art stator apparatus.
Figure 10:
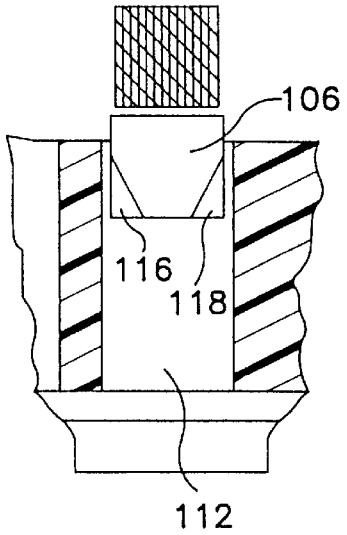
FIG. 10 PRIOR ART
FIG. 10 is a partial cross-sectional view as taken along lines 10—10 of FIG. 9.

Another prior art stator (indicated generally at 104) is illustrated in FIGS. 9 and 10. Similar to stator 92, a circuit grounding member 106 also extends in this case from the top surface 108 of housing 110. Unlike stator 92, however, grounding member 106 is not inserted into a bore in housing 110. Instead, grounding member 106 extends into a channel 112 on the side of housing 110. As a result, electrical contact is achieved between grounding member 106 and core 114. Spring tabs 116 and 118 are also defined in grounding member 106 as shown.

It will be appreciated that the a design of stator 104 causes grounding member 106 to be under core 114. As a result, core 114 is itself modified to accommodate grounding member 106. Specifically, a notch 120 is defined in core 114 to accommodate the bend in grounding member 106, as shown.

Figure 11:
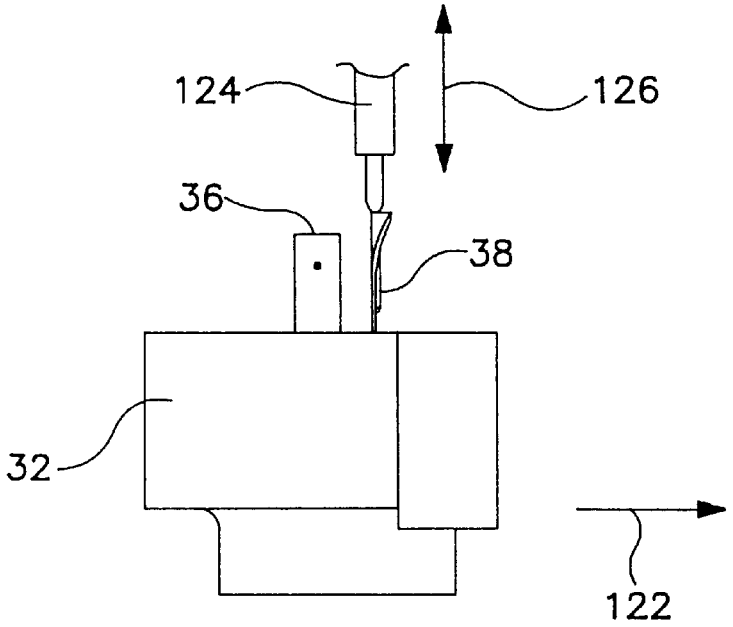
FIG. 11 is a side elevational view of a stator apparatus constructed in accordance with the present invention diagrammatically illustrating testing of internal circuit components thereof.

FIG. 11 illustrates another advantage which may be achieved according to the present invention. Here, housing 32 is illustrated in an intermediate stage of production in which the internal circuit components have been encapsulated but prior to attachment of core 30. As shown, housing 32 is proceeding in series along a conveyor, as indicated by arrow 122. Upon reaching a predetermined testing station, a testing probe 124 may descend onto grounding member 38 as indicated by arrow 126. When testing probe 124 is in this position, various diagnostic tests may be performed to the circuitry within housing 32. After these diagnostic tests have been performed, testing probe 124 may be reciprocatively retracted. If these diagnostic tests are failed, housing 32 may be rejected. If the diagnostic tests are passed, housing 32 may proceed to the next station in the assembly line.

A degree of rigidity is thus desirable in grounding member 38 to prevent flexing under the influence of testing probe 124. For example, flexing of grounding member 38 in this situation may cause electrical contact between probe 124 and grounding member 38 to be lost. Automated processing equipment may identify the particular unit to be faulty in this case, when, in fact, the unit is not faulty. As a result, an acceptable unit may be discarded inadvertently. In a mass production situation, this could lead to considerable unnecessary expense.

As described above, the use of spot welded grounding members, such as member 20 of stator 10, allowed such members to be relatively thick. As a result, the desired rigidity was easily attained. In the present case, however, it is preferable that grounding member 38 be constructed so that it may be easily bent at a later stage of production. Thus, rigidity is provided by longitudinal ridge 70 as described above.

Figure 12C:
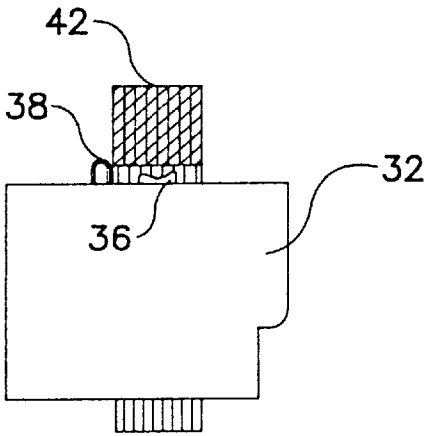
FIGS. 12A—12C are elevational views of the side opposite the side shown in FIG. 11 diagrammatically illustrating some steps of a method of assembling a stator apparatus in accordance with the present invention.
Figure 12B:
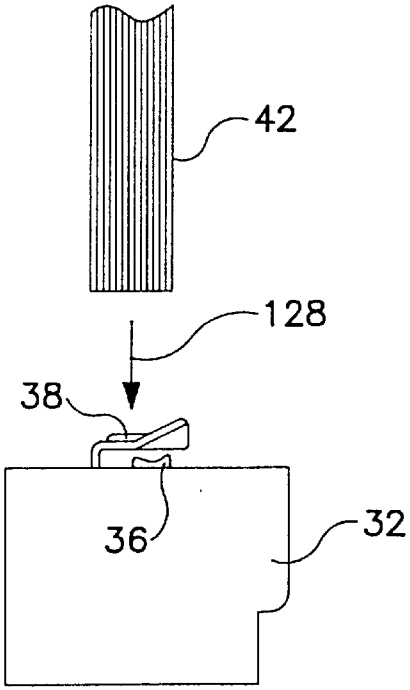
Figure 12A:
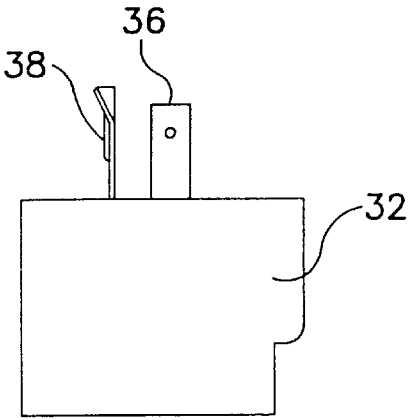

FIGS. 12A through 12C sequentially illustrate the mounting of housing 32 to core 30 after testing as shown in FIG. 11. Specifically, FIG. 12A illustrates the situation in which grounding member 38 is upwardly extending as immediately after testing. In FIG. 12B, grounding member 38 is shown folded over the mouth of receiving bore 58. Leg portion 42 of core 30 is then inserted into receiving bore 58, as indicated by arrow 128. As a result, grounding member 38 will be inserted into receiving bore 58 alongside leg portion 42, as shown in FIG. 12C. The upper portion of terminal 36 is shown cut away in FIGS. 12A and 12B so that insertion of member 38 may be more easily seen.

It should be appreciated that the portion of member 38 that is folded over in the step of FIG. 12B is preferably no more than can easily be pushed into bore 58. Preferably, this folded portion will extend a distance approximately equal to the width of bore 58.

Figure 13:
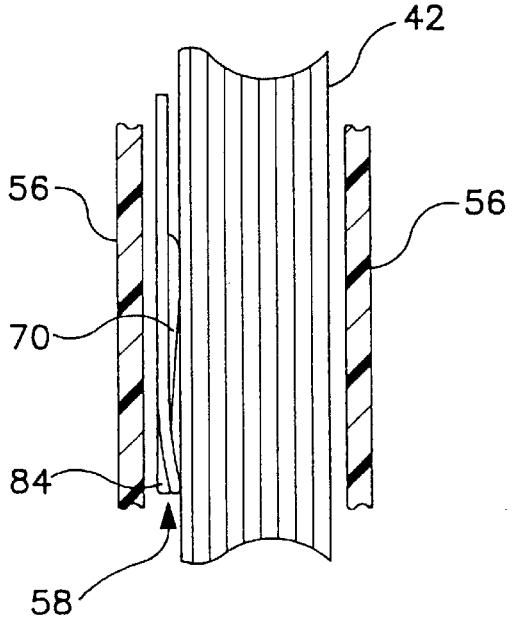
FIG. 13 is an enlarged view illustrating frictional contact of a circuit grounding member with the core of the stator apparatus in accordance with the present invention.

FIG. 13 shows an enlarged view of grounding member 38 as it may appear when inserted into receiving bore 58. As can be seen, spring tab 84 is directed into contact with the outer surface of leg portion 42. Although not shown, spring tab 86 is similarly directed. Additionally, longitudinal ridge 70 is biased into frictional contact with leg portion 42. Thus, in addition to providing increased rigidity during assembly of stator 28, ridge 70 facilitates enhanced electrical connection between grounding member 38 and core 30.

Figure 14:
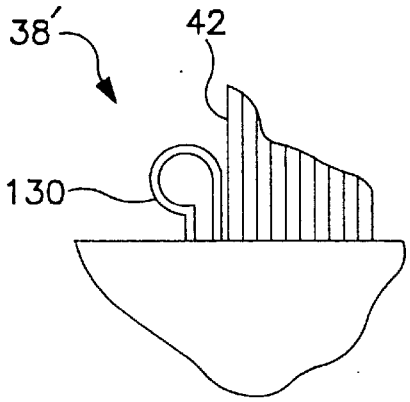
FIG. 14 illustrates an enhanced radius defined in the bend of the circuit grounding member in accordance with another embodiment of the present invention.

In the embodiment described above, the bend at which member 38 is folded into bore 58 is relatively sharp. In some applications, this may lead to crimp fatigue in member 38 at this location. Such crimp fatigue may cause member 38 to break, resulting in an interruption in the ground connection. Thus, an alternative configuration of the bend of the grounding member is illustrated in FIG. 14. In this case, a grounding member 38 is provided having a bend portion 130 characterized by an enhanced radius with respect to the embodiment described above. This enhanced radius functions to lessen the crimp fatigue applied to member 38 at this bend location. Preferably, portion 130 is characterized by a radius of at least one and one-half (1.5) millimeters.

It should be appreciated that modifications and variations to the present invention may be practiced by those of ordinary skill in the art, without departing from the spirit and scope of the present invention, which is more particularly set forth in the appended claims. In addition, it should be understood that aspects of various embodiments may be interchanged both in whole or in part. Furthermore, those of ordinary skill in the art will appreciate that the foregoing is by way of example only and is not intended to be limitative of the invention so further described in such appended claims.

What is claimed is:

1. A method of assembling a stator apparatus for use in an ignition system of an internal combustion engine, said method comprising the steps of:

(a) providing an ignition coil unit including a circuit grounding member having an unencapsulated portion extending vertically upwardly from a housing body thereof in a direction substantially parallel to a central receiving bore defined in said housing body, said unencapsulated portion of said circuit grounding member defining a longitudinal ridge therein to provide stiffening;

(b) moving a testing probe into contact with said circuit grounding member to test electrical characteristics of the ignition coil unit;

(c) folding said unencapsulated portion of the circuit grounding member such that a folded portion thereof extends transversely to an opening of said central receiving bore; and (d) pushing a longitudinal portion of a magnetically permeable core onto the folded portion of the circuit grounding member and through said central receiving bore, thereby attaining electrical connection between said circuit grounding member and said core through frictional contact therebetween.

2. A method as set forth in claim 1, wherein said unencapsulated portion of said circuit grounding member is folded to have an enhanced radius portion defined at a bend location thereof.

* * * * *